US008613492B2

(12) United States Patent
Suzuki et al.

(10) Patent No.: US 8,613,492 B2
(45) Date of Patent: Dec. 24, 2013

(54) INKJET APPARATUS AND METHOD OF JUDGING REPLACEMENT TIMING FOR COMPONENTS OF THE APPARATUS

(75) Inventors: Kazuo Suzuki, Yokohama (JP); Yutaka Kawamata, Koganei (JP); Toshimitsu Danzuka, Tokyo (JP); Masataka Kato, Yokohama (JP); Asako Tomida, Kawasaki (JP); Jumpei Jogo, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 13/160,787

(22) Filed: Jun. 15, 2011

(65) Prior Publication Data

US 2011/0310159 A1 Dec. 22, 2011

(30) Foreign Application Priority Data

Jun. 22, 2010 (JP) ..... 2010-141658

(51) Int. Cl.

| | |
|---|---|
| ***B41J 29/38*** | (2006.01) |
| ***B41J 2/195*** | (2006.01) |
| ***B41J 29/393*** | (2006.01) |
| ***B41J 2/165*** | (2006.01) |

(52) U.S. Cl.
USPC ..... 347/19; 347/14; 347/6; 347/7; 347/23

(58) Field of Classification Search
USPC ..... 347/14, 19, 23, 34, 6–7, 9, 85
See application file for complete search history.

(56) References Cited

U.S. PATENT DOCUMENTS

| | | | | |
|---|---|---|---|---|
| 2008/0084442 | A1* | 4/2008 | Misumi | 347/14 |
| 2009/0021548 | A1* | 1/2009 | Suzuki et al. | 347/14 |
| 2010/0302297 | A1 | 12/2010 | Suzuki et al. | |

FOREIGN PATENT DOCUMENTS

JP 2005-246697 A 9/2005

* cited by examiner

*Primary Examiner* — Jason Uhlenhake
(74) *Attorney, Agent, or Firm* — Fitzpatrick, Cella, Harper & Scinto

(57) ABSTRACT

In an inkjet apparatus using an inkjet head ejecting multiple types of inks different in viscosity after evaporation of solvent, a replacement timing for a component is judged by using a consumption amount of each type of ink and a generation rate in amount of ink droplets. Accordingly, in the case of using a large amount of ink strongly susceptible to fixed adhesion and increase in viscosity, the component is replaced at an earlier timing, which prevents fixed adhesion from influencing the print performance and the printing apparatus main body. By contrast, in the case of using a large amount of ink less susceptible to fixed adhesion and increase in viscosity, the component is replaced at a later timing and thus can be used until reaching its lifetime.

9 Claims, 12 Drawing Sheets

| DISTANCE BETWEEN PRINT HEAD AND PRINT MEDIUM | INK MIST GENERATION RATE |
|---|---|
| LOW | 0.001 |
| MEDIUM | 0.002 |
| HIGH | 0.004 |

FIG.7

| DISTANCE BETWEEN PRINT HEAD AND PRINT MEDIUM | HEAD DRIVE CONDITION | HEAD TEMPERATURE | INK MIST GENERATION RATE |
|---|---|---|---|
| LOW | A | ~50℃ | 0.0008 |
| | | 50~60℃ | 0.001 |
| | | 60℃~ | 0.0012 |
| | B | ~50℃ | 0.0012 |
| | | 50~60℃ | 0.0015 |
| | | 60℃~ | 0.0018 |
| MEDIUM | A | ~50℃ | 0.0016 |
| | | 50~60℃ | 0.002 |
| | | 60℃~ | 0.0024 |
| | B | ~50℃ | 0.0024 |
| | | 50~60℃ | 0.003 |
| | | 60℃~ | 0.0036 |
| HIGH | A | ~50℃ | 0.0032 |
| | | 50~60℃ | 0.004 |
| | | 60℃~ | 0.0048 |
| | B | ~50℃ | 0.0048 |
| | | 50~60℃ | 0.006 |
| | | 60℃~ | 0.0072 |

FIG.8

INKJET APPARATUS AND METHOD OF JUDGING REPLACEMENT TIMING FOR COMPONENTS OF THE APPARATUS

BACKGROUND OF THE INVENTION

1. Field of the Invention

The present invention relates to an inkjet apparatus using an inkjet head ejecting multiple types of inks different in viscosity after evaporation of solvent, and a method for judging replacement timings for components of the apparatus.

2. Description of the Related Art

When ejecting a liquid from a print head, an inkjet apparatus also generates droplets (hereinafter, also called a mist) each smaller than a main droplet. A mist does not adhere only to an ejection surface. While floating in an air current within a printing apparatus, the mist may adhere also to components constituting the printing apparatus such as a mechanism for moving a print medium and an inkjet head relative to each other, a mechanism for performing a recovery operation, and a sensor for performing detection required to perform a printing operation. In other words, the adhesion of ink adversely affects not only the inkjet head but also the components constituting the printing apparatus. As the viscosity increases due to evaporation of ink solvent, the performance of each component, particularly movable components, is reduced, and eventually the performance of the printing apparatus main body cannot be maintained. For this reason, it is necessary to know how much the viscosity of mist adhering to each of these components in the apparatus main body is increased and to make a maintenance such as replacement of the component when it is estimated that the component performance is reduced to such an extent that the performance of the printing apparatus main body cannot be maintained.

To counter such problem, Japanese Patent Laid-Open No. 2005-246697 discloses a configuration which is provided with an ink collecting unit for collecting mist and a fan for generating an air current to suction the mist and lead it toward the collecting unit. Moreover, Japanese Patent Laid-Open No. 2005-246697 discloses a technique in which the amount of ink accumulated in the ink collecting unit as a result of the mist suction is calculated by estimating the amount of mist generated, and, when the amount reaches the maximum ink amount collectable by the ink collecting unit, replacement of the ink collecting unit is prompted.

In an inkjet apparatus, an air current occurs due to ejection of main droplets, and, particularly in a so-called serial printing apparatus, an air current occurs also by the movement of an inkjet head. It should be considered that these air currents also affect the floating state of mist. In other words, not all of the generated mist is necessarily led to the collecting unit by simply generating an air current to suction the mist and lead it toward the collecting unit as in Japanese Patent Laid-Open No. 2005-246697. Accordingly, adhesion of mist on the components constituting the printing apparatus cannot be effectively prevented by this configuration.

Accordingly, it is still necessary to know how much the viscosity of mist adhering to each of the components in the apparatus main body is increased and to make a maintenance such as replacement of the components when it is estimated that the component performance is reduced to such an extent that the performance of the printing apparatus main body cannot be maintained. The technique disclosed in Japanese Patent Laid-Open No. 2005-246697, however, is only for replacement of the collecting unit, and does not consider adhesion of mist on other components in the main body. Moreover, even if the generated mist is effectively led to the collecting unit by the technique disclosed in Japanese Patent Laid-Open No. 2005-246697, the mist may adhere to the suction fan itself in some cases. However, this problem is not recognized in Japanese Patent Laid-Open No. 2005-246697.

As described above, in a situation where an ink of strong tendency to adhere fixedly, particularly an ink which increases in viscosity along with the evaporation of ink solvent, is being used more and more, it is highly desirable to know how much the viscosity of mist adhering to each of the components in the main body is increased and to appropriately know the replacement timing. Moreover, the degree of increase in viscosity along with the evaporation of ink solvent is different depending on the type of ink used in the printing apparatus. Thus, it is highly desirable to appropriately know how much the fixed adhesion is developed and the replacement timing while considering such difference as well.

SUMMARY OF THE INVENTION

In view of the above-described problems, an object of the present invention is to enable each of components in an inkjet apparatus main body to be replaced at an appropriate timing in consideration of types of inks used in a printing apparatus, the components including moveable components such as a mechanism for moving a print medium and an inkjet head relative to each other.

In an aspect of the present invention, there is provided an inkjet apparatus using an inkjet head ejecting a plurality of types of inks different in viscosity after evaporation of solvent, the inkjet apparatus comprising:

an acquisition unit configured to acquire information about a consumption amount of each of the plurality of types of inks; and a judgment unit configured to judge a replacement timing for a component constituting the inkjet apparatus by using the information acquired by the acquisition unit and a generation rate in amount of ink droplets different from main ink droplets ejected from the inkjet head.

In another aspect of the present invention, there is provided a judging method for judging a replacement timing for a component constituting an inkjet apparatus using an inkjet head ejecting a plurality of types of inks different in viscosity after evaporation of solvent, the method comprising the steps of:

acquiring information about a consumption amount of each of the plurality of types of inks; and judging a replacement timing for the component by using the information acquired in the acquisition step and a generation rate in amount of ink droplets different from main ink droplets ejected from the inkjet head.

According to the present invention, a replacement timing for a component is judged by using the consumption amounts of the respective multiple types of inks different in viscosity after evaporation of solvent and the generation rate in amount of ink droplets. Accordingly, the component is replaced at an earlier timing when a large amount of ink which is strongly susceptible to fixed adhesion and increase in viscosity is used, which prevents fixed adhesion from influencing the print performance and the printing apparatus main body. By contrast, when a large amount of ink which is less susceptible to fixed adhesion and increase in viscosity is used, the component is replaced at a later timing and thus can be used until reaching its lifetime.

Further features of the present invention will become apparent from the following description of exemplary embodiments (with reference to the attached drawings).

BRIEF DESCRIPTION OF THE DRAWINGS

FIG. 7 is a view showing an ink mist generation rate for each of distances between an inkjet head and a print medium according to a second embodiment of the present invention;

FIG. 8 is a view showing the ink mist generation rate for each of head drive conditions and head temperatures according to the second embodiment of the present invention;

DESCRIPTION OF THE EMBODIMENTS

Hereinafter, some embodiments of an inkjet apparatus of the present invention and a method for judging a replacement timing for a component constituting the apparatus will be described in detail with reference to the drawings. The present invention is widely applicable to inkjet apparatuses using media such as paper, cloth, leather, nonwoven fabric, plastic sheet, metal, and substrate. Specific application examples include printing machines such as printers, copiers, and facsimile machines using an inkjet method, industrial production equipment, sprayers, and so on.

First Embodiment

Figure 1:
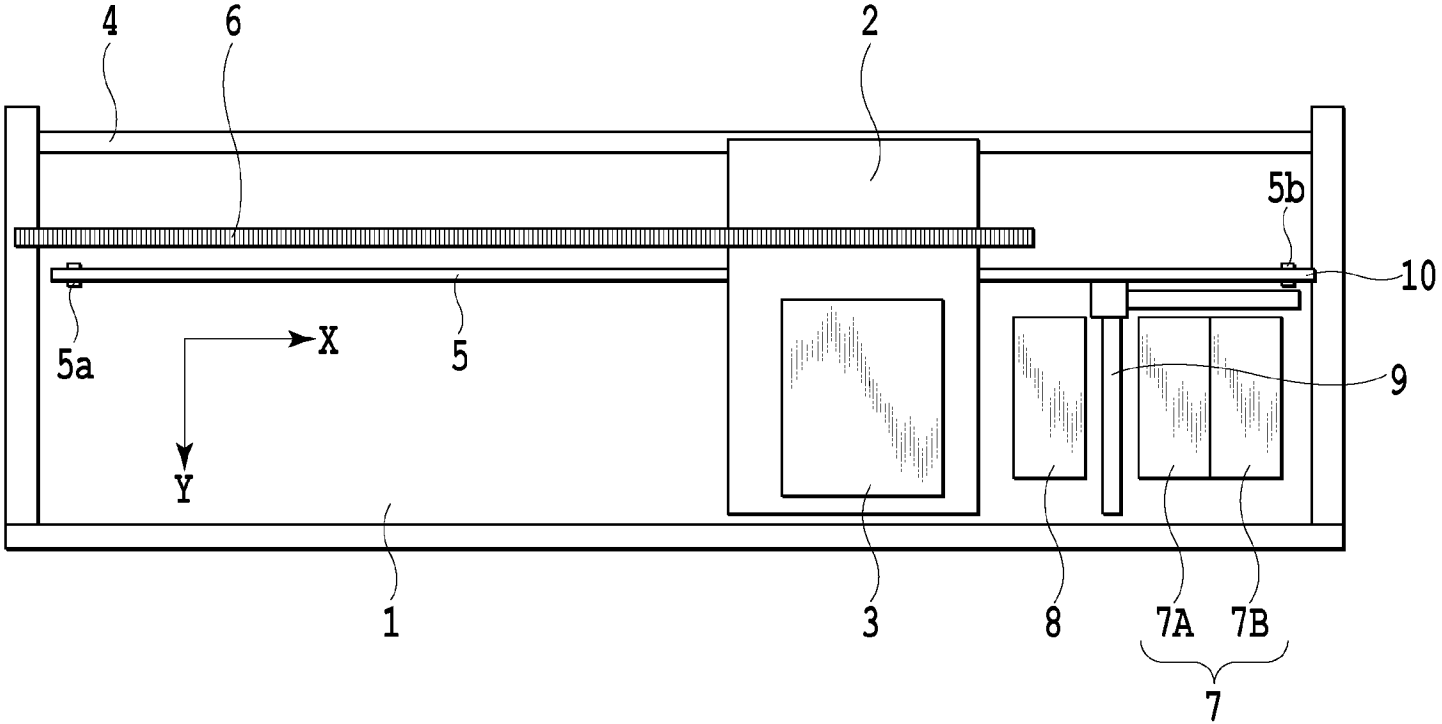
FIG. 1 is a schematic plan view showing an inkjet apparatus according to a first embodiment of the present invention.

FIG. 1 is a schematic plan view showing an inkjet apparatus according to a first embodiment of the present invention. In FIG. 1, reference numeral 1 denotes a printing apparatus main body including various mechanisms, such as a conveying unit (not shown) for a print medium. In this embodiment, the printing apparatus is a serial printing apparatus. This type of printing apparatus performs the printing operation while causing the conveying unit to intermittently convey a print medium in a Y direction and moving an inkjet head 3 in an X direction intersecting the Y direction that is a conveying direction of the print medium. Moreover, the printing apparatus main body 1 shown in FIG. 1 has a size large in the X direction so that printing can be performed on a relatively large-sized (for example, A1 size) print medium.

In addition, in FIG. 1, reference numeral 2 denotes a carriage. The inkjet head 3 is detachably mounted on the carriage 2. The carriage 2 reciprocates together with the inkjet head 3 in the X direction intersecting the conveying direction of print medium. Specifically, while movably supported along a guide shaft 4 extending in the X direction, the carriage 2 is fixed to an endless belt 5 that moves substantially parallel to the guide shaft 4. The endless belt 5 is stretched between a pair of pulleys 5*a*, 5*b* provided on both sides of the movable range of the inkjet head 3. One of the pulleys is connected to a shaft of a carriage motor (CR motor; not shown in FIG. 1). Thus, the endless belt 5 is rotated by rotation drive of the CR motor, and this allows reciprocation of the carriage 2 in the X direction.

Figure 2:
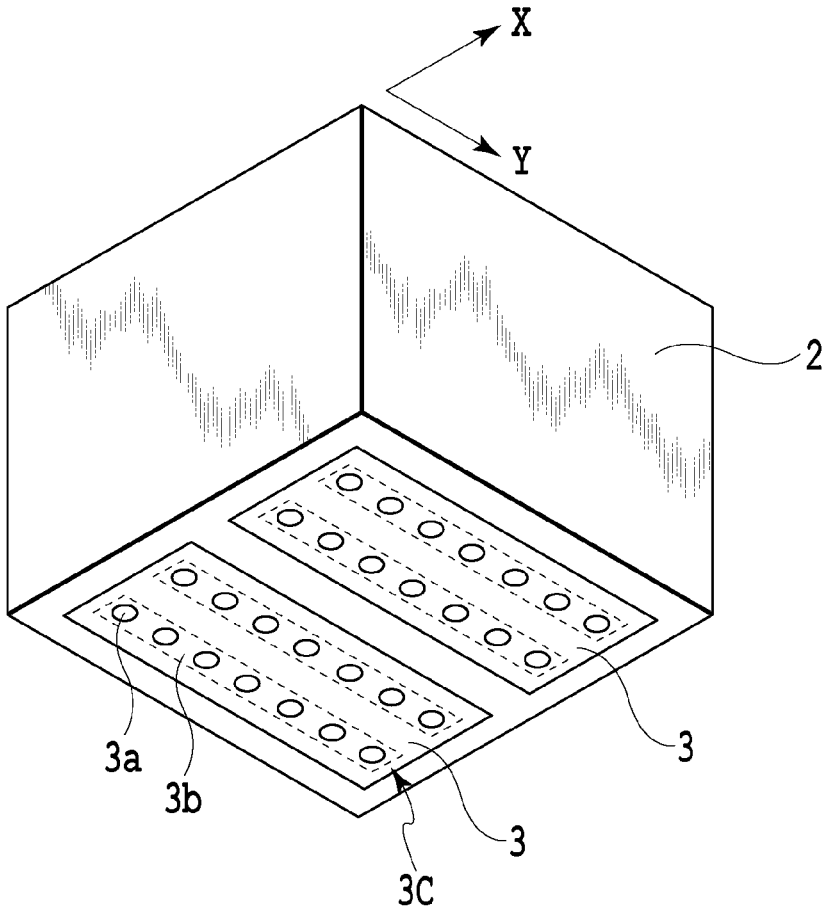
FIG. 2 is a schematic perspective view showing a configuration example of an inkjet head mounted on a carriage in FIG. 1.

FIG. 2 is a schematic perspective view showing a configuration example of the inkjet head 3 mounted on the carriage 2. Multiple ejection openings 3*a* are formed in a face of the inkjet head 3 facing a print medium. Note that, hereinafter, the above face is sometimes referred to as an ejection face. FIG. 2 shows an example in which two inkjet heads 3 are integrally provided in the carriage 2. However, the inkjet head 3 to which the present invention is applicable is not limited to this.

The inkjet head 3 is provided with: the multiple ejection openings 3*a* formed on the ejection face 3*b*; multiple liquid paths communicating respectively with the multiple ejection openings 3*a* for supplying the ink; and a common liquid chamber communicating with the liquid paths for ink in common for storing the ink. Note that, hereinafter, a combination of each of the ejection openings with the corresponding liquid path is sometimes referred to as a nozzle. Further, unless otherwise particularly distinguished, the ink and the treatment solution are collectively referred to as a liquid. In the inkjet head 3 of this embodiment, 1280 ejection openings 3*a* are arranged for every kind of liquid (i.e., for one color ink) in the Y direction that is the conveying direction of print medium, enabling printing at a density of 1200 dpi (dots per inch). The ejection openings for ink are provided in a region 3*c* on the ejection face in FIG. 2. Further, the number and type of the color tone (hue, concentration) of ink used, and the kind (dye, pigment, or the like) of the color material mainly contained, can also be determined as appropriate. For example, it is possible to use four kinds of inks respectively containing color materials of cyan, magenta, yellow, and black. FIG. 2 shows a configuration provided with four arrays of the ejection openings in total: four arrays of the ejection openings for these respective four kinds of inks. Ink tanks containing the color inks supply the inks to the common liquid chambers for the arrays of the ejection openings for color inks, respectively. Incidentally the ink tanks can be provided at fixed positions of the printing apparatus separately from the carriage 2, and configured to supply the inks with tubes made of a flexible material that can follow the movement of the carriage 2. Alternatively, the inks may be supplied from liquid tanks that are provided to the carriage 2 or the inkjet head 3 in a separable or inseparable manner.

Refer to FIG. 1 again. In the printing apparatus, a recovery operation unit 7 is fixed at a predetermined position of the printing apparatus main body 1. The recovery operation unit 7 is for maintaining or recovering the condition of ejecting a liquid from each ejection opening 3*a* of the inkjet head 3 in or to a good condition. In the present embodiment, the recovery operation unit 7 includes: suction recovery mechanisms 7A, 7B; a lifting-lowering mechanism (not shown) for lifting/ lowering the suction recovery mechanisms 7A, 7B; a wiping mechanism 9; and a receiving box 8.

In this example, the two suction recovery mechanisms 7A, 7B are provided, and are driven to be lifted or lowered by the lifting-lowering mechanism. Each of the suction recovery mechanisms 7A, 7B includes a cap (not shown) that is movable between a position where three arrays of the ejection openings are covered (capped) and a position that is away from the ejection face. The cap is capable of performing an operation (suction recovery operation) of forcing a liquid to be discharged by driving a pump (not shown) at the capping position to thereby exert the sucking force to the ejection unit. In other words, the suction recovery operation is an operation of forcibly sucking liquids from the multiple nozzles formed in the inkjet head to refresh the liquids in the nozzles into a condition suitable for ejection.

Moreover, the recovery operation unit 7 of this example is capable of performing preliminary ejection that is ejection of the ink into the receiving box 8 with the inkjet head 3 facing the receiving box 8. Further, the recovery operation unit 7 of this example is provided with the wiping mechanism 9 at an end portion of the movable range of the inkjet head 3 (for example, the home position of the inkjet head). The wiping mechanism 9 is capable of moving a wiping blade 10 while sliding it on the ejection face 3*b* of the inkjet head 3. Thereby, a liquid mist, which differs from main ink droplets ejected from the inkjet head, dust, and the like adhering to the ejection face 3*b* are wiped off.

Figure 3:
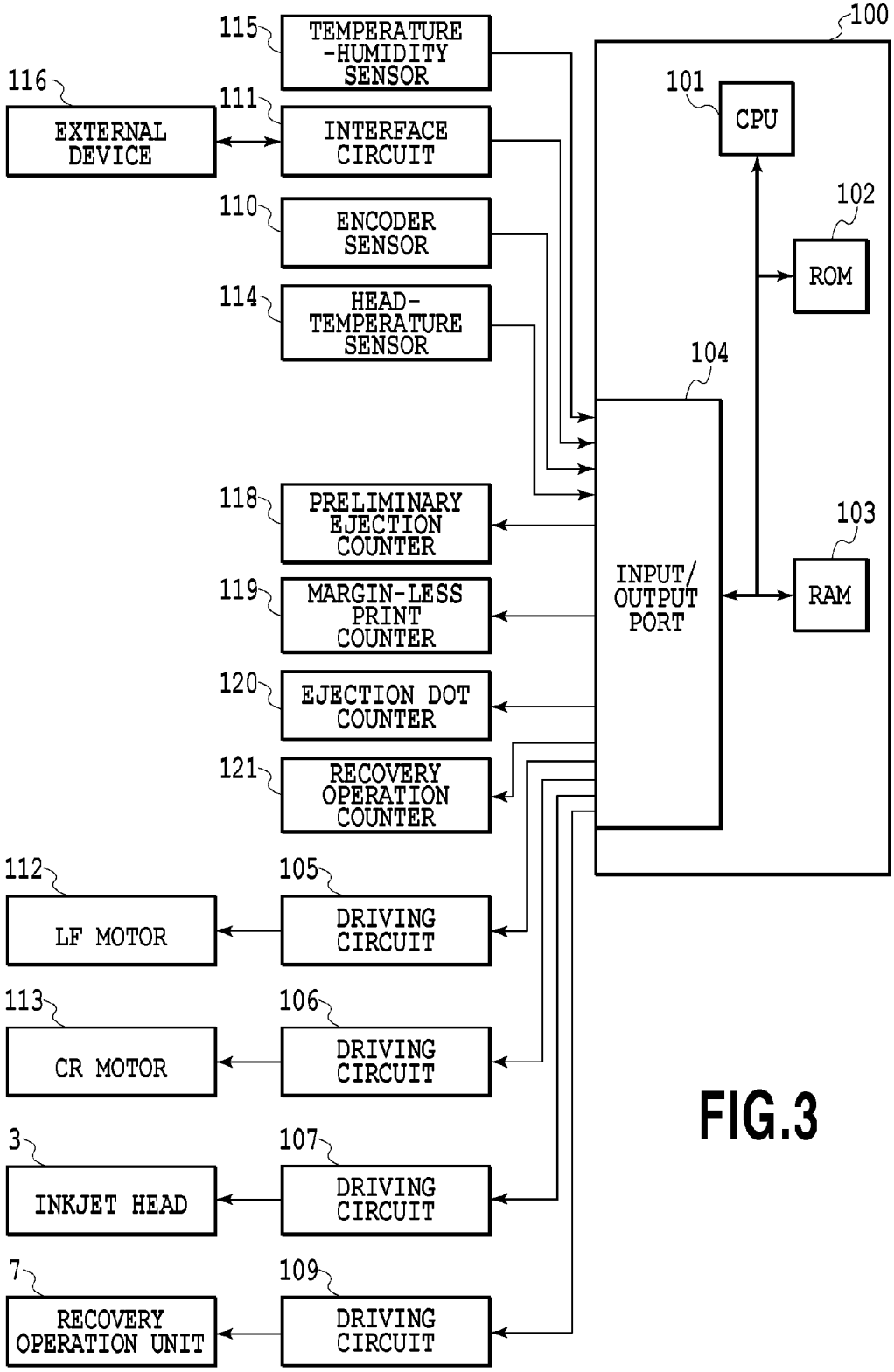
FIG. 3 is a block diagram showing a configuration of a control system used in a printing apparatus main body of the inkjet apparatus according to the embodiment of the present invention.

FIG. 3 is a block diagram showing a configuration of a control system used in the printing apparatus main body 1 of the inkjet apparatus of this embodiment. In FIG. 3, reference numeral 100 denotes a main controller that includes a CPU 101, a ROM 102, a RAM 103, an input/output port 104, and so forth. The CPU 101 executes processes such as calculation, control, determination, and setting that need to be performed in the processing procedure to be described later referring to FIG. 4. The ROM 102 stores a program corresponding to the processing procedure to be executed by the CPU 101, other fixed data, and the like. The RAM 103 is used as a buffer for storing binary print data representing ejection/non-ejection of ink, a work area for the processing by the CPU 101, and the like.

The input/output port 104 is used to transmit/receive required data between the main controller 100 or the CPU 101 and each unit to be described below. Hence, the input/output port 104 is connected to driving circuits 105, 106, 107, and 109 that respectively corresponds to a conveyance motor (LF motor) 112, a carriage motor (CR motor) 113, the inkjet head 3, and the recovery operation unit 7. Note that the LF motor 112 is a motor used as a drive source for causing the conveying unit to convey a print medium. The CR motor 113 is a motor used as a drive source for moving the carriage 2 or the inkjet head 3 over a print medium. The driving circuit 107 is a circuit for driving the inkjet head 3 in accordance with the binary print data representing ejecting/not-ejecting ink, while the inkjet head 3 is moving. Further, the driving circuit 109 is a circuit for driving the lifting-lowering mechanism for the cap, a pump activating mechanism, and the wiping mechanism in the recovery operation unit 7.

The input/output port 104 is further connected to: a head-temperature sensor 114 that is a unit for detecting the temperature of the inkjet head; an encoder sensor 110 fixed to the carriage 2; and a temperature-humidity sensor 115 that detects a temperature and humidity which are the environment conditions where the main body 1 is used. In addition to these, for example, a sensor for detecting a leading end and a trailing end of a print medium, a sensor for detecting the distance (gap) between the inkjet head and a print medium, or the like may be connected to the input/output port 104.

Moreover, the main controller 100 or the input/output port 104 is connected to an external device 116 through an interface circuit 111, which allows to transmit/receive various information such as image data to be printed, required control data, and the status of the printing apparatus main body 1. The external device 116 serves as a source of supplying print data to the printing apparatus, and has an appropriate form such as a personal computer, a scanner, and a digital camera.

The input/output port 104 is further connected to a preliminary ejection counter 118, a margin-less print counter 119, an ejection dot counter 120, and a recovery operation counter 121. Here, the preliminary ejection counter 118 counts the number of dots ejected from the nozzle in the preliminary ejection before printing is started, after printing is completed, or during printing. The margin-less print counter 119 counts the number of ink dots ejected to a region outside a print medium, which are necessary for printing with no margin left in at least one edge portion of the print medium (i.e., margin-less printing). The ejection dot counter 120 counts the number of ink dots ejected during printing. The recovery operation counter 121 counts an amount of ink which is forcibly discharged from the inkjet head 3 by the recovery operation unit 7. Note that it is needless to say that the ejection dot counter 120 and the recovery operation counter 121 are updated and managed cumulatively per one replacement cycle in a process to be described later for the purpose of knowing timings of replacing components in the printing apparatus.

Next, description will be given for the outline of the printing operation executed by the inkjet apparatus having the above-described configuration. When print data is received from the external device 116 through the interface circuit 111, the print data is loaded to the buffer of the RAM 103. Then, when a printing operation is instructed, the conveying unit including the LF motor is activated, and a print medium is conveyed to a position facing the inkjet head 3. The carriage 2 is moved in the X direction along the guide shaft 4. During the movement, liquid droplets are ejected from the inkjet head 3, and an image of a band is printed on the print medium. Thereafter, the conveying unit conveys the print medium in the Y direction intersecting the moving direction of the carriage 2 by a predetermined amount (for example, by a band width corresponding to the length of the array of the ejection openings). By repeating these operations of conveying the print medium and of moving the inkjet head, an image is formed on the print medium according to the print data.

Note that the main controller 100 detects the position of the carriage 2 by counting a pulse signal which is outputted from the encoder sensor 110 along with the movement of the carriage 2. Specifically, the encoder sensor 110 detects portions to be detected which are formed at certain intervals in an encoder film 6 (see FIG. 1) disposed in the X direction. Thereby, the encoder sensor 110 outputs the pulse signal to the main controller 100. The main controller 100 counts the pulse signal, and thus detects the position of the carriage 2. The carriage 2 moves to the home position or other positions based on the signal from the encoder sensor 110.

As described above, in a situation where such an ink that increases in viscosity along with the evaporation of ink solvent is used more and more, it is highly desirable to know how much the viscosity of mist adhering to each of the components within the main body is increased and to know an appropriate replacement timing for the component. Moreover, the degree of increase in viscosity along with the evaporation of the solvent is different depending on the type of ink used in the printing apparatus. Thus, it is highly desirable to know how much the fixed adhesion is developed and the replacement timing in consideration of this difference.

Figure 4:
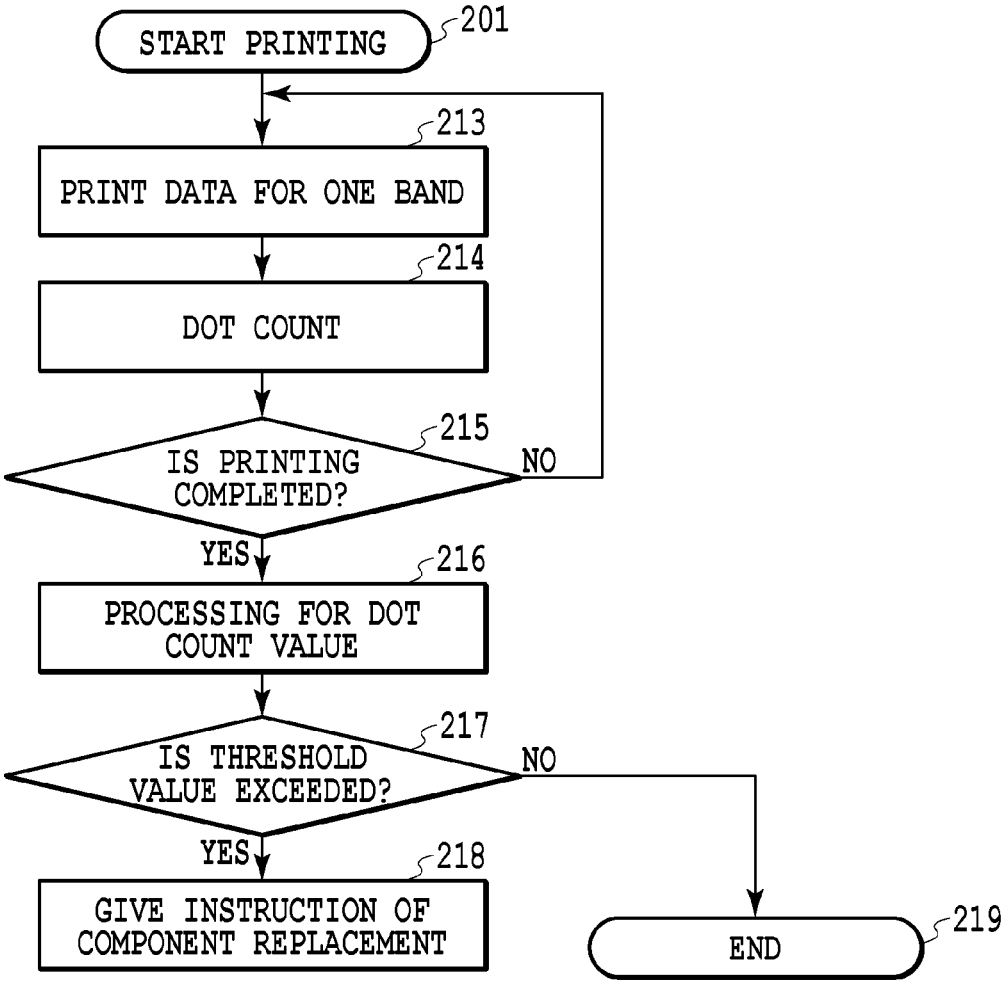
FIG. 4 is a flowchart showing an example of a procedure of processing performed by the inkjet apparatus according the embodiment of the present invention.

FIG. 4 shows an example of a processing procedure which is performed to counter the problems described above and which is particularly suitable for judging the lifetime of a carriage moving mechanism including the carriage 2, the guide shaft 4, and the endless belt 5 of FIG. 1. This procedure is performed basically based on the number of ink ejections (dot count value). In this embodiment, the dot count value or an ink ejection amount of each type of ink is weighed in accordance with the type of ink. Then, the replacement timing for the carriage moving mechanism is judged or instructed, depending on whether or not the weighted value exceeds a predetermined threshold.

The carriage moving mechanism reaches its lifetime when ink mist mainly generated during the printing adheres to the guide shaft 4 and the like and thus causes a sliding resistance to the carriage. Accordingly, there is a need to know the amount of ink mist adhering to the guide shaft 4 and the sliding resistance caused by the adhering ink mist. It has been found that the sliding resistance differs greatly depending on the type of ink.

Figure 5:
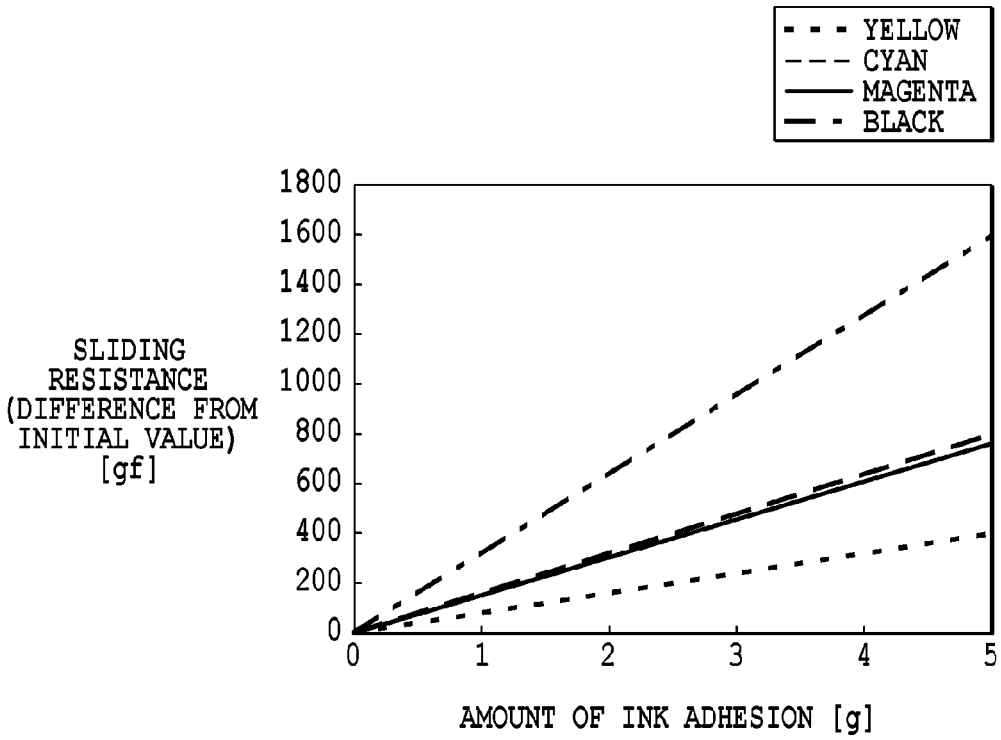
FIG. 5 is a view showing a relationship between a sliding resistance and the amount of ink mist adhering to a guide shaft for each type of ink according to the embodiment of the present invention.

FIG. 5 shows a relationship between the sliding resistance and the amount of ink mist adhering to the guide shaft 4 for each type of ink. As is apparent from this drawing, if the sliding resistance caused by the adhering of mist of a yellow ink is defined as "1", the sliding resistance caused by the adhering of mist of each of a cyan ink and a magenta ink is approximately twice as large, when the same amount of ink adheres. Moreover, the sliding resistance caused by the adhering of mist of a black ink is approximately four times as large, when the same amount of ink adheres. Accordingly, the component lifetime of the carriage moving mechanism in a case of ejecting only the yellow ink is approximately four times longer than in a case of ejecting only the black ink of the same amount, the component lifetime determined by an increase in the sliding resistance of the guide shaft 4. The difference in increase in sliding resistance depending on the type of ink is strongly related to the viscosity after evaporation of ink solvent.

Figure 6:
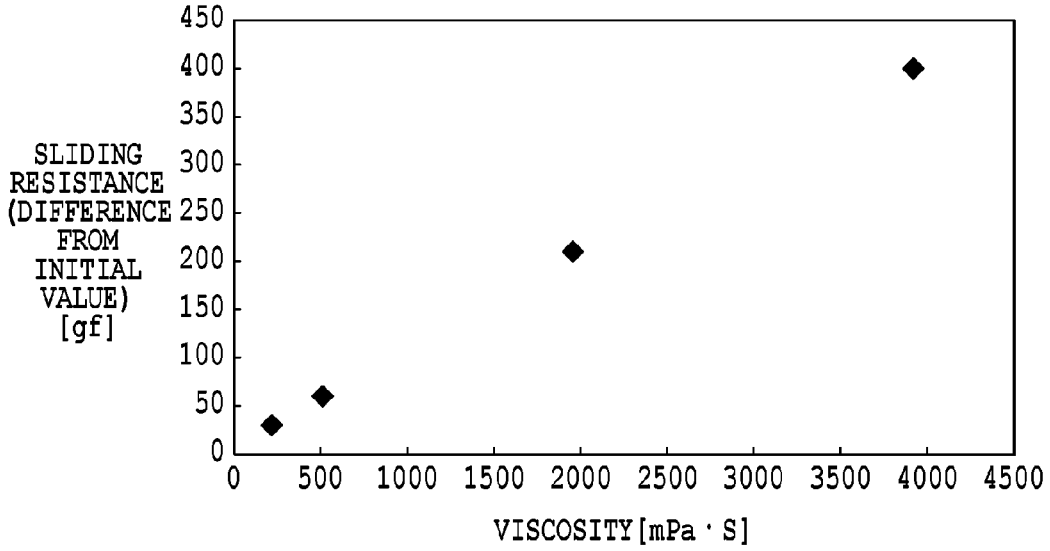
FIG. 6 shows a relationship between the sliding resistance and the viscosity after evaporation of solvent for each type of ink according to the embodiment of the present invention.

FIG. 6 shows a relationship between the sliding resistances and the viscosities after the evaporation. The viscosities were measured as described below. The evaporation of the ink solvents was promoted in a high-temperature low-humidity environment, and each of inks was left as it is until the decrease in weight due to evaporation was saturated. The inks were then measured using RE80U viscometer manufactured by TOKI SANGYO CO., LTD. A weight coefficient to be multiplied by the dot count value or the ink ejection amount of each type of ink was set as described below in view of this measurement. Specifically, the coefficients for the yellow ink, the cyan ink, the magenta ink, and the black ink were set to "1", "2", "2", and "4", respectively. Note that, these coefficients may be provided, for example, in the ROM 102 as fixed data.

In FIG. 4, first, the printing operation is started (Step 201). Next, if print data of one band is printed (Step 213), the ejection dot counter 120 counts the number of dots ejected for the print data of the one band, for each color (each type) of ink (Step 214). Then, whether or not print data of the following one band exists is judged (Step 215). If the judgment is positive, Steps 213 to 215 are repeated for the print data of the following one band. Meanwhile, if the judgment is negative (i.e., printing is completed), the processing proceeds to the dot count processing (Step 216). Note that, in this example, the processing of Step 214 corresponds to an acquisition unit for acquiring information about a consumption amount of each of multiple types of inks.

In the dot count processing (Step 216), an expected lifetime value of the carriage moving mechanism is calculated based on the dot count values of the respective types of inks. In this embodiment, the expected lifetime value is calculated based on the following formula. Specifically, Expected lifetime value=(yellow ink ejection amount× yellow ink weight coefficient (=1)+cyan ink ejection amount×cyan ink weight coefficient (=2)+ magenta ink ejection amount×magenta ink weight coefficient (=2)+black ink ejection amount×black ink weight coefficient (=4))×ink mist generation rate×ink mist adhesion rate.

In the above formula, each of the amounts of ink ejection is calculated by multiplying the amount of a corresponding ink ejected per one ink dot by the dot count value. The amount of ink ejected per one dot is a known value determined from the ink, the configuration of the head (especially nozzles), and the like. Moreover, the ink mist generation rate is a proportion of the amount of ink which turns into mist to the total amount of ink ejected, and, the ink mist adhesion rate is a proportion of the amount of mist adhering to the guide shaft 4 to the amount of ink which has turned into mist.

It is judged whether or not the expected lifetime value obtained from the above formula exceeds a predetermined threshold (Step 217). If the judgment is positive, an instruction to replace the component is notified to the user (Step 218). On the other hand, if the judgment is negative, the procedure is finished (Step 219). Note that, in a case of giving such an instruction or notification, a display unit or sound generating unit provided in the printing apparatus or in the external device can be used to present the user with information such as which component should be replaced. Note that, in this example, the processing of Steps 216 and 217 correspond to a judgment unit.

As described above, a more accurate lifetime expectation can be made by performing the lifetime expectation based on the viscosities after the evaporation of solvent of the respective types of ink. Thus, instead of a replacement timing of the carriage moving mechanism which is set based on the most severe condition, i.e., ejection of only the black ink, the replacement timing of the carriage moving mechanism is set based on an adequate condition set in consideration of the amounts of consumption of inks of respective colors. For example, compared to the case where the replacement timing of the carriage moving mechanism is set based on the ejection of only the black ink, if inks of all the colors are evenly used, the replacement cycle can be made approximately twice as long. This leads to reduction in the running cost of the printing apparatus.

Second Embodiment

The second embodiment of the present invention is an example in which additions are made to the first embodiment described above to obtain the ink mist generation rate more accurately. A lifetime expectation formula similar to the first embodiment is also used in this embodiment. However, the ink mist generation rate is made variable depending on the usage condition of the apparatus.

It is known that the ink mist generation rate depends on a distance between an inkjet head 3 and a print medium. In some inkjet apparatuses, the distance between the inkjet head 3 and the print medium, i.e. the height level of the inkjet head 3 with respect to the print medium, can be changed among three levels of, for example, "low", "medium", and "high" in accordance with the type of print medium and use environment of the apparatus. Thus, in this embodiment, the ink mist generation rate is changed in accordance with the distance as illustrated in FIG. 7, and more accurate lifetime detection is performed. In addition to the distance between the inkjet head 3 and the print medium described above, the ink mist generation rate changes due to the drive condition of the inkjet head and the temperature of the inkjet head in some cases. Thus, as shown in FIG. 8, these factors can be additionally considered to perform even more accurate lifetime detection. The drive condition of the inkjet head specifically includes an ejection duty, a so-called block drive method, and the like. In the block drive method, all of the nozzles arrayed in the ejection unit are not driven at the same timing. Instead the nozzles are divided into multiple blocks each including a predetermined number of nozzles, and the blocks are sequentially driven in time division. In a situation where the number of nozzles to be included in the ejection unit tends to be larger, this method is particularly effective in suppressing the required electric power for one drive timing. Moreover, in some cases, two different types of block drive orders are used in accordance with print modes, and the adhesion state of the ink mist may be changed depending on the type of block drive order used in some cases. Thus, it is effective to additionally consider the block drive orders.

Third Embodiment

A third embodiment of the present invention is an example in which the present invention is applied to the lifetime judgment of a movable unit different from that of the first embodiment, particularly of the wiping mechanism 9 of FIG. 1.

Figure 9:
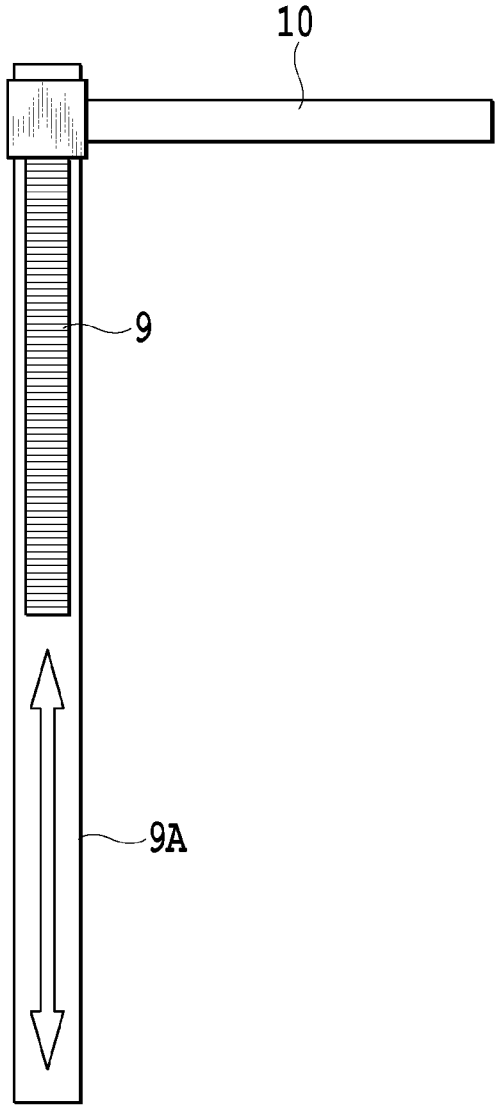
FIG. 9 is a schematic view for explaining a wiping mechanism according to a third embodiment of the present invention.
Figure 10:
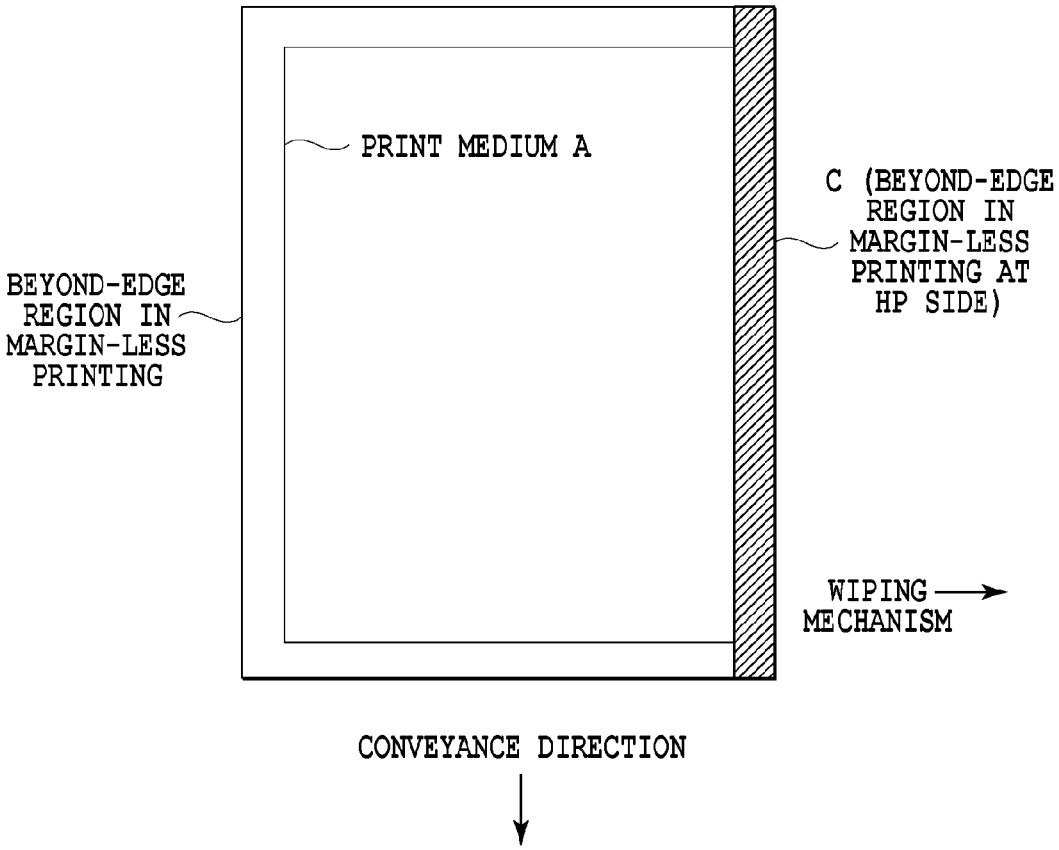
FIG. 10 is a schematic view for explaining a region outside a print medium to which ink is ejected in margin-less printing, according to the third embodiment of the present invention.

FIG. 9 shows a detailed configuration of the wiping mechanism 9. The wiping mechanism 9 reaches its lifetime when ink mist mainly ejected to the receiving box 8 during preliminary ejection adheres to a rail guide 9A of the wiping mechanism 9 and increases in viscosity to thereby cause increase in sliding resistance. Moreover, among ink mist ejected to a region outside a print medium during the margin-less printing, ink mist ejected to a region outside the print medium on the wiping mechanism side also adheres to the rail guide of the wiping mechanism 9. Hereafter, this region will be referred to as a "beyond-edge region in margin-less printing at home position (HP) side", and the amount of ink ejected to this region will be referred to as a "beyond-edge ejection amount in margin-less printing at HP side". FIG. 10 shows a region in which ink is ejected outside a print medium A during the margin-less printing, and a hatched portion C particularly shows the "beyond-edge region in margin-less printing at HP side".

In this embodiment, as similar to the first embodiment, a formula for judging the lifetime of the wiping mechanism 9 is set as described below in view of degrees of fixed adhesion and increase in viscosity of each type of ink.

Expected lifetime value=(yellow ink preliminary ejection amount×yellow ink weight coefficient+cyan ink preliminary ejection amount×cyan ink weight coefficient+magenta ink preliminary ejection amount×magenta ink weight coefficient+black ink preliminary ejection amount×black ink weight coefficient)×ink mist generation rate×ink mist adhesion rate+(yellow ink's beyond-edge ejection amount in margin-less printing at HP side×yellow ink weight coefficient+cyan ink's beyond-edge ejection amount in margin-less printing at HP side×cyan ink weight coefficient+magenta ink's beyond-edge ejection amount in margin-less printing at HP side×magenta ink weight coefficient+black ink's beyond-edge ejection amount in margin-less printing at HP side×black ink weight coefficient)×ink mist generation rate in margin-less printing at HP side×ink mist adhesion rate in margin-less printing at HP side.

Note that, in the above formula, the weight coefficients for the yellow ink, the cyan ink, the magenta ink, and the black ink were set to "1", "2", "2", and "4", respectively. The amount of preliminary ejection of each ink is calculated by multiplying the amount of the ink ejected per one dot by the dot count value for the preliminary ejection. The amount of the ink ejected per one dot is a known value determined from the ink, the configuration of the head (especially nozzles), and the like. Moreover, the dot count value of each type of ink for the preliminary ejection is measured by a preliminary ejection dot counter 117. Furthermore, the ink mist generation rate is a proportion of the amount of ink which turns into mist to the total amount of ink ejected in the preliminary ejection, and the ink mist adhesion rate is a proportion of the amount of mist adhering to the rail guide of the wiping mechanism 9 to the amount of ink which has turned into mist.

Meanwhile, "beyond-edge ejection amount in margin-less printing at HP side" of each type of ink is calculated by multiplying the amount of the ink ejected per ink dot by the number of ejections for "beyond-edge ejection amount in margin-less printing at HP side" of the ink. The ink ejection amount per one dot is a known value determined from the ink, the configuration of the head (especially nozzles), and the like. Moreover, the dot count value of each type of ink in the preliminary ejection is measured by the preliminary ejection dot counter 117. Each of the ink ejection amounts is a known value determined from the ink, the configuration of the head, and the like, and the number of ejections for "beyond-edge region in margin-less printing at HP side" of each type of ink is measured by a margin-less print counter 119. Furthermore, ink mist generation rate in "margin-less printing at HP side" is a proportion of the amount of ink which turns into mist to the "beyond-edge ejection amount in margin-less printing at HP side", and ink mist adhesion rate in "margin-less printing at HP side" is a proportion of the amount of mist adhering to the rail guide of the wiping mechanism 9 to the amount of ink which has turned into mist.

In this embodiment, as similar to the first embodiment, if the expected lifetime value of the wiping mechanism 9 obtained from the above formula exceeds a threshold, an instruction to replace the component is notified to the user. This is because there is a possibility of the wiping mechanism 9 breaking the inkjet head 3 and other components if the wiping mechanism 9 performs wiping despite having reached its lifetime.

As described above, an accurate lifetime expectation can be made on the lifetime of a moveable unit different from that in the first embodiment, i.e., the wiping mechanism, by performing the lifetime expectation based on the viscosity after evaporation of solvent of each type of ink. As a matter of course, as described in the second embodiment, a control may be added which is performed in accordance with the distance between the inkjet head and the print medium, the inkjet head drive condition, the inkjet head temperature condition, and the like.

Fourth Embodiment

In the first embodiment described above, consideration has been made on degrees of adhesion and of increase in viscosity which are different depending on the type of ink. However, it has been found that degrees of adhesion and of increase in viscosity depend also on an environment in which the apparatus is used. Thus, in the fourth embodiment of the present invention, a more adequate lifetime expectation is performed in accordance with the environment in which the apparatus is used.

Figure 11:
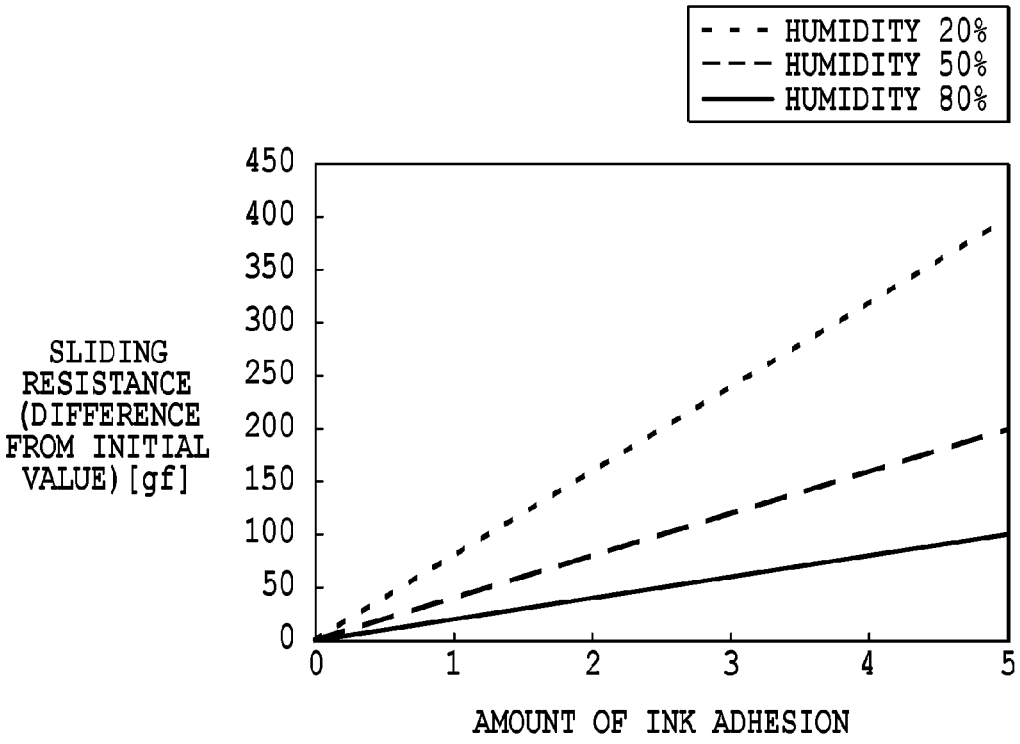
FIG. 11 is a view showing a relationship between a sliding resistance and the amount of ink mist adhering to a guide shaft for each environmental humidity in which the apparatus is used, according to a fourth embodiment of the present invention.
Figure 12:
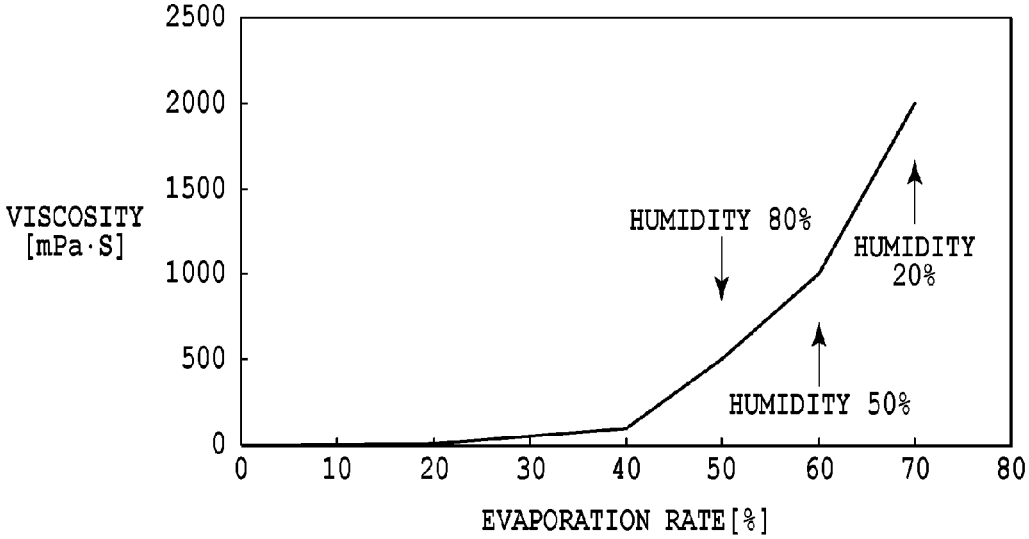
FIG. 12 is a view showing a relationship between an ink mist evaporation rate and a viscosity after evaporation of solvent according to the fourth embodiment of the present invention.

FIG. 11 is a graph which shows a relationship between a sliding resistance and the amount of ink adhering to a guide shaft 4 in a case of a yellow ink, for each of environmental humidity at which the apparatus is used. Specifically, if the sliding resistance caused by the adhering of mist of the yellow ink in a 20% humidity environment is defined as "1", the sliding resistance in a 50% humidity environment is approximately 0.5, the sliding resistance in a 80% humidity environment is approximately 0.25, when the same amount of ink mist adheres. Accordingly, a component lifetime of a carriage moving mechanism in a case of using the apparatus in the 80% humidity environment is four times longer than a case of using the apparatus in the 20% humidity environment, the component lifetime determined by the sliding resistance of the guide shaft 4. This is because the viscosity after evaporation changes due to variation in the evaporation rate of ink solvent depending on the environmental humidity, as shown in FIG. 12.

In this embodiment, in view of difference in tendency of fixed adhesion among the above described use environments, a formula for judging the lifetime of the carriage moving mechanism is set as described below by additionally considering humidity information from a temperature-humidity sensor 115 provided in the apparatus. Specifically, Expected lifetime value=(yellow ink ejection amount× yellow ink weight coefficient+cyan ink ejection amount×cyan ink weight coefficient+magenta ink ejection amount×magenta ink weight coefficient+black ink ejection amount×black ink weight coefficient)×ink mist generation rate×ink mist adhesion rate.

Note that, the weight coefficient of the yellow ink in humidity lower than 20% is "1", that in humidity equal to or higher than 20% and lower than 50% is "0.5", and that in humidity equal to or higher than 50% is "0.25". Moreover, the weight coefficient of each of the cyan ink and the magenta ink in humidity lower than 20% is "2", that in humidity equal to or higher than 20% and lower than 50% is "1", and that in humidity equal to or higher than 50% is "0.5". Furthermore, the weight coefficient of the black ink in humidity lower than 20% is "4", that in humidity equal to or higher than 20% and lower than 50% is "2", and that in humidity equal to or higher than 50% is "1". In this embodiment, as similar to the first embodiment, if the expected lifetime value calculated from the above formula exceeds a threshold, an instruction to replace the component is notified to the user.

As described above, an even more accurate lifetime expectation can be made by performing the lifetime expectation in accordance with the environment in which the apparatus is used in addition to the tendency of fixed adhesion of each type of ink. Thus, instead of a replacement timing of the carriage moving mechanism which is set based on the most severe condition, i.e., ejection of only the black ink in low humidity condition, the replacement timing of the carriage moving mechanism can be set based on an adequate condition set in consideration of the humidity condition and the consumed ink amounts of respective ink colors. For example, compared to the case where the replacement timing of the carriage moving mechanism is set based on the most severe condition described above, if inks of all colors are evenly used in a high humidity environment, the replacement cycle can be made approximately eight times as long. This leads to reduction in the running cost of the printing apparatus.

As a matter of course, as described in the second embodiment, a control may be added which is performed in accordance with the distance between the inkjet head and the print medium, the inkjet head drive condition, the inkjet head temperature condition, and the like. Moreover, an even finer control can be performed by adding environment conditions such as temperature in addition to the humidity.

(Others)

The lifetime expectation of the carriage moving mechanism and that of the wiping mechanism have been described separately in different embodiments. However, the above-described embodiments can be combined as appropriate. Moreover, the present invention is also applicable to lifetime judgment for other moveable units such as a fan which generates an air current for collecting ink mist, a conveyance mechanism for a print medium, and a mechanism for collecting ink which is produced by the preliminary ejection and the suction recovery operation. Furthermore, the present invention is also applicable to lifetime judgment for other components, such as various sensors, which can make the performance of the printing apparatus main body unable to be maintained due to the adhesion of mist. In addition, the types of inks, the number of types of inks, values of coefficients corresponding to the respective types of inks described above are merely examples, and any alternative can be selected as appropriate.

Moreover, the description has been given for the case where the present invention is applied to a so-called serial printing apparatus. However, as a matter of course, the present invention is applicable also to a so-called line printer-type printing apparatus that uses a print head in which ejection openings are arranged across the width of a print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-141658, filed Jun. 22, 2010, which is hereby incorporated by reference herein in its entirety.

What is claimed is:

1. An inkjet apparatus using an inkjet head ejecting a plurality of types of inks different in viscosity after evaporation of solvent, the inkjet apparatus comprising:

an acquisition unit configured to acquire information about a consumption amount of each of the plurality of types of inks; and a judgment unit configured to judge a replacement timing for a component constituting the inkjet apparatus by using the information acquired by the acquisition unit and a generation rate of ink mist different from main ink droplets ejected from the inkjet head, wherein the judgment unit calculates by weighting such that an ink with higher viscosity after the evaporation of solvent has a larger coefficient to be multiplied by the consumption amount thereof.

2. The inkjet apparatus according to claim 1, wherein the judgment unit changes the generation rate used to judge the replacement timing on the basis of at least one of a distance between the inkjet head and a print medium, a temperature of the inkjet head, a drive condition of the inkjet head, and a use environment condition of the inkjet apparatus.

3. The inkjet apparatus according to claim 1, wherein the component is at least one component included in a carriage moving mechanism, a conveying mechanism for print medium, a recovery operation device for maintaining or recovering a liquid ejection condition in or to a good condition, a mechanism for collecting ink generated in a recovery operation, an ink mist collecting mechanism, and a sensor used for a printing operation.

4. An inkjet apparatus using an inkjet head ejecting a plurality of types of inks different in viscosity after evaporation of solvent, the inkjet apparatus comprising:

an acquisition unit configured to acquire information about a consumption amount of each of the plurality of types of inks; and a judgment unit configured to judge a replacement timing for a component constituting the inkjet apparatus by using the information acquired by the acquisition unit and a generation rate of ink mist different from main ink droplets ejected from the inkjet head, wherein the judgment unit changes the generation rate used to judge the replacement timing on the basis of at least one of a distance between the inkjet head and a print medium, a temperature of the inkjet head, a drive condition of the inkjet head, and a use environment condition of the inkjet apparatus.

5. The inkjet apparatus according to claim 4, wherein the inkjet head drive condition includes a drive order in time-division driving of a plurality of blocks into which a plurality of nozzles disposed in the inkjet head are divided.

6. The inkjet apparatus according to claim 4, wherein the use environment condition includes at least one of temperature and humidity.

7. The inkjet apparatus according to claim 4, wherein the component is at least one component included in a carriage moving mechanism, a conveying mechanism for print medium, a recovery operation device for maintaining or recovering a liquid ejection condition in or to a good condition, a mechanism for collecting ink generated in a recovery operation, an ink mist collecting mechanism, and a sensor used for a printing operation.

8. A judging method for judging a replacement timing for a component constituting an inkjet apparatus using an inkjet head ejecting a plurality of types of inks different in viscosity after evaporation of solvent, the method comprising the steps of:

acquiring information about a consumption amount of each of the plurality of types of inks; and judging a replacement timing for the component by using the acquired information and a generation rate of ink mist different from main ink droplets ejected from the inkjet head, wherein the judgment is performed with a calculation by weighting such that an ink with higher viscosity after the evaporation of solvent has a larger coefficient to be multiplied by the consumption amount thereof.

9. The method according to claim 8, wherein the judgment is performed by changing the generation rate used to judge the replacement timing on the basis of at least one of a distance between the inkjet head and a print medium, a temperature of the inkjet head, a drive condition of the inkjet head, and a use environment condition of the inkjet apparatus.

* * * * *